United States Patent [19]

Sommerfeldt et al.

[11] 4,170,395

[45] Oct. 9, 1979

[54] CONTACT FOR THE BASE PORTIONS OF LOW VOLTAGE-HEAVY DUTY SAFETY FUSES

[75] Inventors: Heinz Sommerfeldt, Erlangen; Karl Kuklies, Duisburg-Hamborn, both of Fed. Rep. of Germany

[73] Assignee: Siemens Aktiengesellschaft, Berlin and Munich, Fed. Rep. of Germany

[21] Appl. No.: 920,553

[22] Filed: Jun. 29, 1978

[30] Foreign Application Priority Data

Jul. 1, 1977 [DE] Fed. Rep. of Germany ..... 2729854

[51] Int. Cl.[2] ..... H01R 13/16

[52] U.S. Cl. ..... 339/259 F

[58] Field of Search ..... 339/258 R, 258 F, 258 P, 339/258 RR, 258 T, 258 TC, 259, 262

[56] References Cited

FOREIGN PATENT DOCUMENTS

| | | | |
|---|---|---|---|
| 1061409 | 7/1959 | Fed. Rep. of Germany | 339/258 F |
| 883203 | 11/1961 | United Kingdom | 339/258 R |
| 1248551 | 10/1971 | United Kingdom | 339/259 R |

*Primary Examiner*—Joseph H. McGlynn

*Attorney, Agent, or Firm*—Scully, Scott, Murphy & Presser

[57] ABSTRACT

A contact having essentially the configuration of a planar strip angled to one side thereof. In the lengthier non-angled region, the strip is provided with a longitudinal slit and flanged at its end portion. The inwardly located slit end is widened in a circular shape. An omega-shaped compression spring has the ends thereof engaged in recesses arranged in said flanged portion and proximate its ends is provided with outwardly extending lugs in its plane of extension.

2 Claims, 3 Drawing Figures

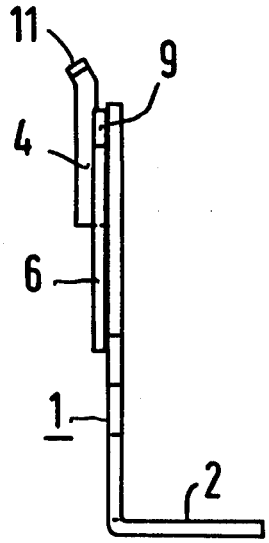

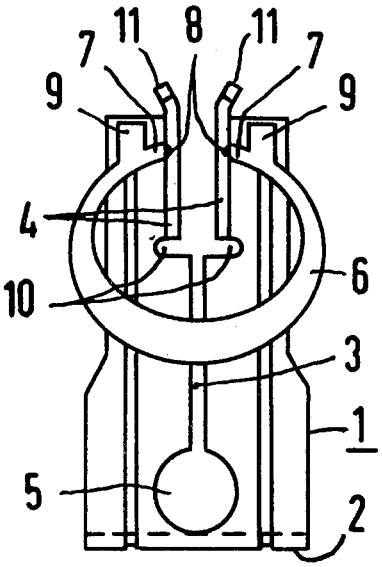

CONTACT FOR THE BASE PORTIONS OF LOW VOLTAGE-HEAVY DUTY SAFETY FUSES

BACKGROUND OF THE INVENTION

1. Field of the Invention

The present invention relates to a contact for the base or sub-portions of LV-heavy duty safety fuses, for the receipt of the blade contacts of the latter, which is supported through the utilization of a compression spring. In this instance, the term LV-heavy duty fuse is the usual designation for low voltage-heavy duty safety fuses.

2. Discussion of the Prior Art

In LV-heavy duty safety fuses, the compression spring is usually riveted thereto in order to prevent it from tipping sideways away from the contact, whose elastic force it should support relative to the knife blades of the fuse wire inserts. A riveting of that kind represents a relatively difficult operation and, moreover, can influence the elastic quality.

SUMMARY OF THE INVENTION

Accordingly, it is an object of the present invention to develop a contact which, as a whole, may be easily manufactured and which is supported by a compression spring secured so as to be reliable during operation without the necessity for being riveted thereto.

The foregoing object is attained in that the contact evidences the configuration of a flat strip angled on one side thereof, and which is longitudinally slit in the non-angled lenthier region, whereby the strip member is flanged at its end along the slit and the inwardly located slit end is circularly expanded, and wherein an omega-shaped compression spring having its ends engaged into recesses in the flanged region of the strip member, incorporates outwardly extending lugs proximate its ends in its plane of extension.

This contact has the advantage that it is unitarily formed, can be easily manufactured by means of a stamping process and provides for a good resilience without the danger of fatiguing. The circularly-shaped expansion at the inwardly located slit end, on the one hand, affords the constant spring effect and, on the other hand, permits electrical lead-in conductors to be conveyed through the contact. Hereby, safety fuse base or sub-portions can be constructed smaller-sized and more variable in their construction.

BRIEF DESCRIPTION OF THE DRAWINGS

Reference may now be had to a preferred embodiment of a contact constructed pursuant to the invention, taken in conjunction with the accompanying drawings; in which.

DETAILED DESCRIPTION

Figure 1:
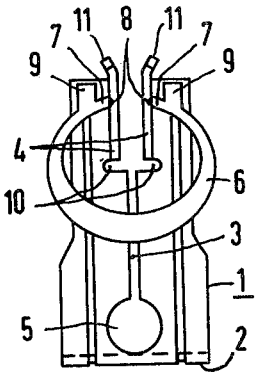
FIG. 1 illustrates a contact for the base portions of LV-heavy duty safety fuses along the viewing direction of the imaginary axis of a safety fuse wire insert which is to be inserted therein; viewing the non-angled region.

The contact 1 constructed in accordance with FIG. 1 of the drawings, essentially has the configuration of a flat or planar strip which has one end angled at one side thereof to form an L shape and is constituted, for example, of copper. The angled region forms the base portion 2 of the L-shaped strip. In the non-angled, lengthier leg portion, which is represented as being in the plane of the drawing, the contact is longitudinally slitted. Along this slit 3, the strip member, for instance constituted of copper, is flanged at its edge portion, in essence within region 4. These portions lie against the sides of the contact blades of LV-heavy duty safety fuses which are to be inserted therein. The inwardly located slit end 5 is circularly expanded to form a round aperture so that the spring action of the contact supports its arms respectively encompassing the slit 3. By means of the circularly-shaped expanded slit end 5, on the other side there can be conducted conduits therethrough and connected to the base portion 2. This renders possible a space-saving construction for the base portions of LV-heavy duty safety fuses.

An omega-shaped compression spring 6 which, for example, is constituted of spring steel, has its ends 7 engaged into recesses 8 provided in the flanged region 4 of the strip member. Adjacent its ends 7, the spring indicates that in its extended plane it has formed thereon outwardly projecting lugs 9. The lug ends lie against the strip member when the compression spring 6 tends to rotate about its ends 7 out of the plane of the drawing. Thusly, they form lever arms which prevent an outward rotation and afford the secure retention to the merely inserted compression spring 6.

When the transition towards the flanged region 4 of the strip member is presently constructed as a rounded-off slot 10, this will render easier the transition to the region 4 and will avoid special demands on the material at this location.

Figure 2:
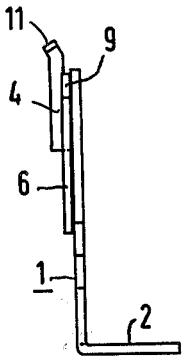
FIG. 2 is a side view of the contact illustrated in FIG. 1.
Figure 3:
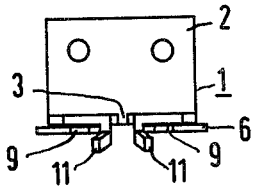
FIG. 3 is a plan view of the contact illustrated in FIG. 1.

In FIGS. 2 and 3 of the drawing, the reference numerals are identical to those utilized in FIG. 1. Projecting points or tips on the contact allow for the easier insertion of knife blade contacts of LV-heavy duty safety fuses which are to be inserted therein. The former are designated by reference numeral 11. Contemplated hereby are two contacts 1 arranged on a single safety fuse base portion.

What is claimed is:

1. In a contact for the base portions of low voltage-heavy duty safety fuses and for the receipt of blade contacts thereof; and a compression spring for supporting said contact; the improvement comprising: said contact having the configuration of a planar strip having one end angled to one side thereof to form the base of an L shape and having a non-angled leg portion lengthier than said base; a longitudinal slit being formed in said non-angled leg portion of the strip, said strip being flanged at its edge extending along said slit, the inwardly located slit end being expanded to form a circularly-shaped aperture; said compression spring being omega-shaped and having ends engaging in recesses arranged in the flanged region of said strip, and said spring including outwardly extending lugs proximate its ends in its plane of extension.

2. A contact as claimed in claim 1, said strip having a transitional portion extending towards the flanged region thereof, said transitional portion having the configuration of a rounded slit.

* * * * *